US006589146B1

(12) United States Patent
Bois

(10) Patent No.: US 6,589,146 B1
(45) Date of Patent: Jul. 8, 2003

(54) METHOD FOR MAKING A PACKAGE COMPRISING A PEELABLE ZONE

(75) Inventor: Henri Georges Bois, Neuilly sur Seine (FR)

(73) Assignee: Flexico-France, Henonville (FR)

( * ) Notice: Subject to any disclaimer, the term of this patent is extended or adjusted under 35 U.S.C. 154(b) by 0 days.

(21) Appl. No.: 09/868,599

(22) PCT Filed: Dec. 21, 1999

(86) PCT No.: PCT/FR99/03219

§ 371 (c)(1),
(2), (4) Date: Jun. 20, 2001

(87) PCT Pub. No.: WO00/37246

PCT Pub. Date: Jun. 29, 2000

(30) Foreign Application Priority Data

Dec. 22, 1998 (FR) ..... 98 16234

(51) Int. Cl.[7] ..... B31B 1/84
(52) U.S. Cl. ..... 493/213; 156/309.6
(58) Field of Search ..... 493/212, 213, 493/214, 267, 264, 382; 383/210, 211; 156/308.2, 309.6

(56) References Cited

U.S. PATENT DOCUMENTS

| | | | | |
|---|---|---|---|---|
| 3,491,935 A | * | 1/1970 | Trotter, Jr. et al. | |
| 3,960,636 A | * | 6/1976 | Moffitt | 100/226 |
| 3,986,914 A | * | 10/1976 | Howard | 156/228 |
| 4,925,318 A | * | 5/1990 | Sorensen | 156/66 |
| 5,628,566 A | * | 5/1997 | Schreiter | 156/66 |
| 5,725,312 A | * | 3/1998 | May | 383/210 |

FOREIGN PATENT DOCUMENTS

| | | |
|---|---|---|
| EP | 398731 | * 11/1990 |
| EP | 513550 | * 11/1992 |

* cited by examiner

*Primary Examiner*—Ted Kavanaugh
(74) *Attorney, Agent, or Firm*—Finnegan, Henderson, Farabow, Garrett & Dunner, L.L.P.

(57) ABSTRACT

A method of manufacturing packages based on a film (10) and presenting at least one peelable zone, the method being characterized by the fact that it comprises the steps which consist in feeding segments (20) of strip or tape of peelable material on a film (10) that is to form the wall of the package, in flattening at least the ends of each segment (20), and in fixing each segment (20) of peelable material to the film (10). The invention also provides a machine for implementing the method, and packages obtained thereby.

16 Claims, 1 Drawing Sheet

METHOD FOR MAKING A PACKAGE COMPRISING A PEELABLE ZONE

Figure 1:
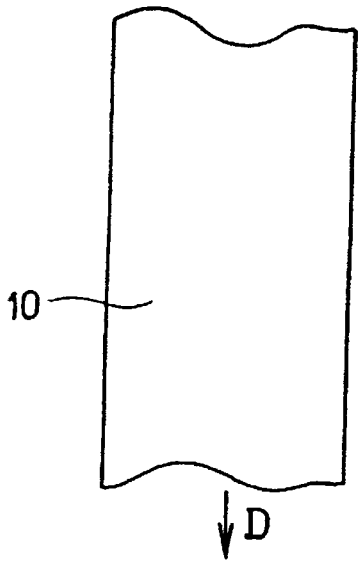

The present invention relates to the field of packaging, in particular bags having complementary closure strips.

Numerous packages or bags including such closure strips have already been proposed.

More precisely still, the present invention relates to packages or bags that include a connection zone that is peelabe, i.e. separable, defined between the inside surfaces of the walls of the package or bag.

Numerous packages or bags of this type are also known.

The function of the peelable zone is to improve leakproofing of the package or bag.

Another function is to make it possible to verify whether or not the package or bag has been opened. If the peelable zone of a package or bag has been separated, that informs a potential purchaser that the package or bag has already been opened.

The peelable zone can be provided on the inside or the outside of the closure strips, relative to the inside volume of the package or bag.

Generally, the peelable zone is made by fitting a strip of peelable material on the film constituting the package or bag, i.e. a strip presenting a melting point that is lower than that of the wall of the package or bag.

An embodiment of such a package is to be found in document U.S. Pat. No. 4,925,318.

Nevertheless, it has been observed that the means proposed in the past for making such packages are very complex and do not give full satisfaction. In particular, they do not always make it possible to guarantee that the package is properly leakproof, specifically at the ends of the peelable strip where they join the side edges of the package, because the lengths of the segments of peelable material fed onto the film constituting the package must be shorter than the width of the film.

Attempts have been made to remedy that difficulty by making the peelable zone without adding material, by applying surface treatment to the film.

Nevertheless that has not given full satisfaction either, in particular because it is complex to implement.

An object of the present invention is to improve performance of known packages.

The main object of the present invention is to provide bags or packages presenting leakproofing that is better than that of previously known bags or packages.

In the context of the present invention, the above object is achieved by the method of manufacturing packages, the method comprising the steps which consist in feeding segments of strip or tape of peelable material onto the film that is to form the wall of the package, the length of the segments while they are being deposited on the film being less than the desired package width, in flattening at least the ends of each segment so that, after flattening, the segments cover the width of said package in full, and in fixing each segment of peelable material to the film.

The present invention also provides a machine for implementing the method, and packages obtained thereby.

Figure 2:
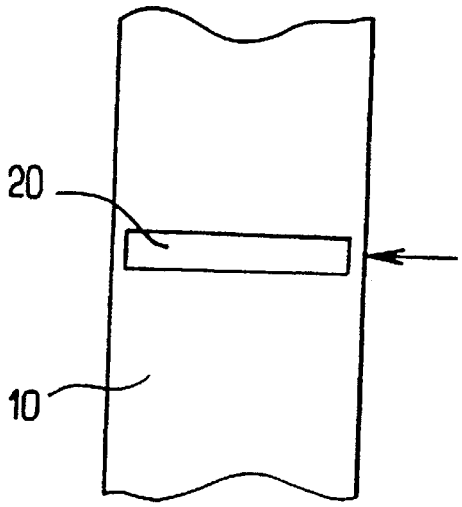
Figure 3:
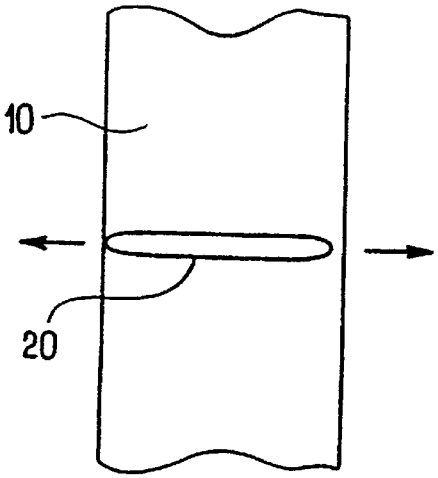
Figure 4:
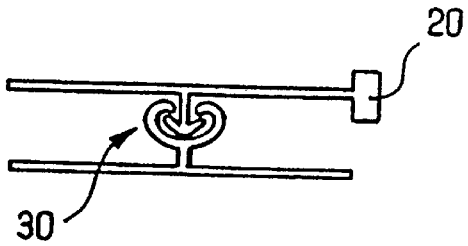

Other characteristics, objects, and advantages of the present invention will appear on reading the following detailed description and with reference to the accompanying drawing, given by way of non-limiting examples, in which:

FIGS. 1, 2, and 3 are diagrams showing three successive steps in the implementation of the method of the present invention; and FIG. 4 is a cross-section view through a closure strip that integrates a peelable segment, constituting a variant of the present invention.

FIGS. 1, 2, and 3 are diagrams of the three basic steps of the method of the present invention.

More precisely, these figures show:

- in FIG. 1, a film 10 that is preferably driven so as to travel continuously lengthwise, in a direction D;
- in FIG. 2, segments of strip or tape of peelable material 20 are fed sequentially onto the film 10, transversely to its travel direction D, at a pitch equal to that of the packages that are to be made from the film; and
- in FIG. 3, a step of flattening the segments 20 and fixing them to the film 10.

On comparing FIGS. 2 and 3, it will be observed that the flattening step leads to the segments 20 becoming longer. Thus, even though the segments 20 are shorter than the width of the film 10 when they are deposited on the film 10, afer they have been flattened in accordance with the present invention, it is possible to obtain segments 20 which cover the entire width of the film 10 and which are consequently suitable for guaranteeing total leakproofing of packages made subsequently therefrom.

In practice, the steps of flattening and fixing the segments 20 on the film 10 can be performed simultaneously. They can also be performed in succession. In which case, it is preferable for the flattening step to be performed prior to the fixing step.

These flattening and fixing steps are preferably performed between two heated jaws.

The peelable material constituting the segments 20 is a material whose melting or softening point is lower than that of the material constituting the main wall of the sheet 10.

By way of non-limiting example, the material constituting the peelable segments 20 is preferably constituted by olefin polymers, ethylene, or propylene.

Also by way of non-limiting example, the material constituting the film 10 is preferably formed by polyolefins.

In the context of the present invention, in order to implement the above-specified method under satisfactory conditions, it is considered that the segments 20 of peelable material should preferably present at least one plane base face for fixing on the film 10. The rest of the section of each segment 20 can be implemented in a wide variety of ways. Thus, the segments 20 can be rectangular or square in section, or even generally rounded.

Furthermore, by way of non-limiting example, the width of the segments 20 preferably lies in the range 1 millimeter (mm) to 10 mm, while the thickness of the segments 20 preferably lies in the range 0.1 mm to 2 mm.

FIGS. 1 to 3 show the steps of a method consisting in depositing the segments of peelable material 20 transversely onto the film 10. However, in a variant, the same method can be implemented by depositing the segments 20 longitudinally on the film 10, i.e. parallel to their length D.

The segments 20 can form integral portions of closure strips 30, being coextruded therewith, as shown diagrammatically in FIG. 4, or else they can be made as separate elements being delivered onto the film 10 parallel to said strips 30.

The packages or bags can be made subsequently using any technique known to the person skilled in the art starting from the sheet 10 having the segments 20 of peelable material strip in accordance with the present invention.

In conventional manner, the peelable strip 20 is brought into contact with the facing surface of the package and is fixed thereto by compression accompanied by supplying heat.

The other conventional operations of forming, filling, and sealing the packages are not described in greater detail below.

Nevertheless, it should be observed that the method of the present invention which consists in feeding the segments 20, in flattening them, and in fixing them onto the film 10 can be followed by a step in which the film is stored, e.g. by being rolled up, with packages proper being made subsequently at a geographical location that may be different from that where the segments 20 were fixed onto the film 10.

However, in a variant, the method of the present invention which consists in feeding the strips 20, in flattening them, and in fixing them to the film 10, can be performed immediately upstream from a form, fill, and seal (FFS) type machine having means for forming packages out of the film, for filling the packages, and for sealing the filled packages.

Such an FFS type machine can comprise a forming throat for shaping the film into a tube, a filling chute which opens out into the resulting tube, means suitable for fixing together the longitudinal edges of the film, and means suitable for operating sequentially to provide transverse lines of heat sealing on the tubular film so as to define the ends of each of the packages.

Naturally, the present invention is not limited to the particular embodiments described above, but extends to any variant within the spirit of the invention.

The present invention can be applied to bags in which the closure strips are actuated by cursors.

In the accompanying drawings, segments 20 of peelable material are shown that practically cover the entire width of the film 10. In which case, the packages are preferably made by superposing the film thus fitted with segments 20 onto another film having the same width and carrying a closure strip complementary to the strip on the first film, but not including a peelable strip.

In contrast, when packages are made using a single sheet folded in half or shaped to form a tube, the length of the segments 20 deposited on the film 10 should be about half the width of the film 20 so that after flattening they cover exactly the width of the final package.

What is claimed is:

1. A method of manufacturing packages having a length and a width transverse to the length based on a film (10) having at least one peelable zone, comprising:

(A) feeding segments (20) of strip or tape of peelable material onto the film 10) in parallel to the width of the package so that a length of said segments of elongated strip or tape of peelable material extends in parallel to said width of the package, wherein the length of the segments (20) of strip or tape of peelable material is less than the package width, while the segments (20) are deposited on the film (10);

(B) flattening at least the ends of each deposited segment (20) to extend the length of each segment so that, after flattening, the segments (20) of strip or tape of peelable material cover all the width of said package in full; and (C) fixing each segment (20) of strip or tape of peelable material to the film (10).

2. The method according to claim 1, wherein the film (10) further comprises complementary closure strips (30).

3. The method of claim 1, wherein the flattening in step (B) and fixing in step (C) are achieved between two heated jaws.

4. The method of claim 1, Wherein the segments (20) are comprised of a material whose melting or softening point is lower than that of the material constituting the wall of the sheet (10).

5. The method of claim 1, wherein the segments (20) are comprised of at least olefin polymers, ethylene, propylene, or mixtures thereof.

6. The method of claim 1, wherein the film (10) is comprised of polyolefins.

7. The method of claim 1, wherein the segments (20) present at least one plane base face for fixing to the film.

8. The method of claim 1, wherein the width of the segments (20) is from 1 mm to 10 mm.

9. The method of claim 1, wherein the thickness of the segments (20) is from 0.1 mm to 2 mm.

10. The method of claim 1, wherein the segments (20) are placed transversely on the film (10).

11. The method of claim 1, wherein the segments (20) are placed longitudinally on the film (10).

12. The method of claim 2, wherein the segments (20) form an integral part of the closure strips (30) and are co-extruded with them.

13. The method of claim 2, wherein the segments (20) are separate from the closure strips (30) and are delivered to the film (10) parallel to the strips (30).

14. The method of claim 1, wherein the segments (20) cover the entire width of the film (10) and packages are made by superimposing the film (10) fitted with the segments (20) on another film, which has the same width and carries a closure strip complementary to the closure strip of the first film (10), wherein said other film does not include a peelable segment.

15. The method of claim 1, wherein the segments (20) placed on the film (10) are about half the length of the film (10), so that when the segments (20) are flattened, they reach the width of the final package.

16. A method of manufacturing packages having a length and a width transverse to the length based on a film (10) having at least one peelable zone, comprising:

(A) feeding segments (20) of elongated strip or tape of peelable material onto the film (10) in parallel to the width of the package so that a length of said segments of elongated strip or tape of peelable material extends in parallel to said width of the package, wherein the length of the segments (20) of strip or tape of peelable material is less than the package width, while the segments (20) are deposited on the film (10); and (B) simultaneously fixing and flattening at least the ends of each deposited segment (20) to extend the length of each segment so that, after flattening, the segments (20) of strip or tape of peelable material cover all the width of said package in full.

* * * * *

UNITED STATES PATENT AND TRADEMARK OFFICE

CERTIFICATE OF CORRECTION

PATENT NO. : 6,589,146 B1
DATED : July 8, 2003
INVENTOR(S) : Henri Georges Bois

It is certified that error appears in the above-identified patent and that said Letters Patent is hereby corrected as shown below:

Column 3,
Line 43, "film 10)" should read -- film (10) --.

Column 4,
Line 4, "Wherein" should read -- wherein --.

Signed and Sealed this

Nineteenth Day of August, 2003

JAMES E. ROGAN
*Director of the United States Patent and Trademark Office*